US011186949B2

(12) United States Patent
Averheim et al.

(10) Patent No.: US 11,186,949 B2
(45) Date of Patent: Nov. 30, 2021

(54) METHOD FOR IMPREGNATING BIOMASS AND DEVICE FOR IMPREGNATING BIOMASS

(71) Applicant: Valmet AB, Sundsvall (SE)

(72) Inventors: Andreas Averheim, Sundsvall (SE); Per Grundström, Sundsvall (SE); Anders Löfström, Alno (SE)

(73) Assignee: Valmet AB, Sundsvall (SE)

( * ) Notice: Subject to any disclaimer, the term of this patent is extended or adjusted under 35 U.S.C. 154(b) by 0 days.

(21) Appl. No.: 16/348,794

(22) PCT Filed: Dec. 7, 2017

(86) PCT No.: PCT/EP2017/081929

§ 371 (c)(1),
(2) Date: May 9, 2019

(87) PCT Pub. No.: WO2018/104489

PCT Pub. Date: Jun. 14, 2018

(65) Prior Publication Data

US 2019/0360150 A1 Nov. 28, 2019

(30) Foreign Application Priority Data

Dec. 8, 2016 (EP) ..... 16202930

(51) Int. Cl.
*D21C 3/04* (2006.01)
*D21C 1/10* (2006.01)
(Continued)

(52) U.S. Cl.
CPC ..... *D21C 3/04* (2013.01); *D21C 1/10* (2013.01); *D21C 7/06* (2013.01); *D21C 7/12* (2013.01)

(58) Field of Classification Search
CPC ... D21C 3/04; D21C 1/10; D21C 7/06; D21C 7/12
(Continued)

(56) References Cited

U.S. PATENT DOCUMENTS 4,187,141 A 2/1980 Ahrel
5,266,159 A * 11/1993 Greenwood ..... D21C 7/12 162/17
(Continued)

FOREIGN PATENT DOCUMENTS

CN 1568246 A 1/2005
CN 101268121 A 9/2008
(Continued)

OTHER PUBLICATIONS

Extended European Search Report in EP Application No. 16202908.6, dated Mar. 13, 2017 (7 pages).
(Continued)

*Primary Examiner* — Jacob T Minskey
(74) *Attorney, Agent, or Firm* — Foley & Lardner LLP

(57) ABSTRACT

The invention relates to a method for impregnating biomass (10). In a step (S100) of the method, a reactor unit (11) is fed with biomass (10) by means of a plug screw (12). In another step (S200), the reactor unit (11) is at least partially filled up to a predetermined fill level (13) with a reactant (18), such that a reaction between the fed biomass (10) and the reactant (18) takes place in order to obtain an impregnated biomass. In another step (S300), the impregnated biomass (10) is discharged from the reactor unit (11) for further processing (S300). The invention further relates to a device (1) for impregnating biomass (10).

16 Claims, 2 Drawing Sheets

(51) Int. Cl.
*D21C 7/06* (2006.01)
*D21C 7/12* (2006.01)

(58) Field of Classification Search
USPC ..... 162/41
See application file for complete search history.

(56) References Cited

U.S. PATENT DOCUMENTS

| | | | | |
|---|---|---|---|---|
| 2004/0060673 | A1 | 4/2004 | Phillips et al. | |
| 2004/0234692 | A1 | 11/2004 | Nopper | |
| 2009/0065158 | A1 | 3/2009 | Benjelloun Mlayah et al. | |
| 2014/0083918 | A1* | 3/2014 | Nguyen | D21C 3/04 210/150 |
| 2014/0315258 | A1 | 10/2014 | Nguyen | |

FOREIGN PATENT DOCUMENTS

| | | | |
|---|---|---|---|
| CN | 101341288 | A | 1/2009 |
| CN | 101798584 | A | 8/2010 |
| CN | 101802299 | A | 8/2010 |
| CN | 101835804 | A | 9/2010 |
| CN | 101952449 | A | 1/2011 |
| CN | 101953226 | A | 1/2011 |
| CN | 102177293 | A | 9/2011 |
| CN | 103097606 | A | 5/2013 |
| CN | 103339237 | A | 10/2013 |
| CN | 103898780 | A | 7/2014 |
| WO | WO-99/41448 | A1 | 8/1999 |
| WO | WO-2004/005608 | A1 | 1/2004 |
| WO | WO-2007/009463 | A2 | 1/2007 |
| WO | WO-2007/063171 | A1 | 6/2007 |
| WO | WO-2009/012779 | A2 | 1/2009 |
| WO | WO-2009/012779 | A3 | 5/2009 |
| WO | WO-2011/039635 | A2 | 4/2011 |
| WO | WO-2015/014364 | A1 | 2/2015 |
| WO | WO-2015/026583 | A1 | 2/2015 |
| WO | WO-2015/199604 | A1 | 12/2015 |
| WO | WO-2016/199604 | A1 | 12/2016 |

OTHER PUBLICATIONS

International Search Report & Written Opinion in International Application No. PCT/EP2017/081929, dated Feb. 1, 2018 (11 pages).

International Search Report and Written Opinion in International Application No. PCT/EP2017/081916, dated Jan. 18, 2018 (11 pages).

International Search Report and Written Opinion in International Application No. PCT/EP2017/081930, dated Feb. 6, 2018 (12 pages).

Foreign Office Action on CN Patent Application No. 201780069706.5 and English translation dated Feb. 26, 2021 (including English translation) (13 pages).

Foreign Office Action on CN Patent Application No. 201780069714.X and English translation dated Mar. 3, 2021 (with English translation) (23 pages).

Hongzhang Chen, Lignocellulose Biorefinery Engineering, Principles and Applications, Woodhead Publishing Series in Energy: No. 74, 2021, 275 pages.

Foreign Office Action on CN Patent Application No. 201780069753.X and English translation dated Mar. 5, 2021 (with English translation) (20 pages).

* cited by examiner

METHOD FOR IMPREGNATING BIOMASS AND DEVICE FOR IMPREGNATING BIOMASS

CROSS-REFERENCE TO RELATED APPLICATIONS

The present application is a U.S. National Phase Entry Application under 35 U.S.C. § 371 that claims the benefit of International Application No. PCT/EP2017/081929, filed on Dec. 7, 2017, and which in turn claims the benefit of EP Application No. 16202930.0, filed on Dec. 8, 2016, the entire disclosures of which are incorporated herein by reference.

FIELD OF THE INVENTION

The invention generally relates to impregnation systems. In particular, the invention relates to a method for impregnating biomass and a device for impregnating biomass.

BACKGROUND OF THE INVENTION

Nowadays, different impregnation systems such as soaking and spraying systems are used for the impregnation of biomass in pulping processes in the paper industry as well as for moisturizing the biomass. The biomass used in such pulping processes may for instance be wood material, agro waste, grass, or residuals from the sugar or ethanol industry. Acid or other catalysts are added to the biomass using soaking or spraying prior to the hydrolysis stage. However, soaking of biomass in commercial hydrolysis systems requires very large tanks, which is not a viable option. Spraying does not allow chemicals to fully penetrate the biomass which results in an uneven distribution of acid and other catalysts leading to deteriorated reaction kinetics in the hydrolysis stage. This in turn leads to a lower dry matter yield and a larger amount of undesired products.

SUMMARY OF THE INVENTION

It is an object of the present invention to provide an enhanced impregnation of biomass.

This object is achieved by the subject-matter of the independent claims. Further exemplary embodiments are evident from the dependent claims and the following description.

According to a first aspect of the invention, a method for impregnating biomass is provided. In a first step of the method, a reactor unit is fed with biomass by means of a plug screw. In another step of the method, the reactor unit is at least partially filled up to a predetermined fill level with a reactant, such that a reaction between the fed biomass and the reactant takes place in order to obtain an impregnated biomass. The reactant, which may be a catalyst, is evenly distributed in the biomass when it is added into the reactor unit. In another step, the impregnated biomass is discharged from the reactor unit for further processing. Further processing may for instance comprise a hydrolysis step, a thermal treatment at a predetermined temperature or the application of a predetermined pressure.

Using such a method for impregnating biomass, in which a predetermined fill level with reactant is present, allows the biomass to be impregnated in a homogenous manner. In other words, the biomass is driven through the reactant within the reactor unit such that the whole biomass can be interspersed with the reactant which results in an improved impregnation of the biomass within the reactor unit. The reactant may for instance be a liquid which is added into the reactor unit and which is filled into the reactor unit until a predetermined fill level is reached. The advantage that the whole biomass, which is conveyed through the reactor unit, can be impregnated, e.g. by interspersing the biomass with the liquid reactant, is based on the fact that no biomass can leave the reaction unit without being homogeneously impregnated. In other words, the liquid reactant is penetrating the material structure and pores of the biomass such that the liquid reactant can be evenly distributed within the biomass.

The method may be used to produce paper, for example after the impregnated biomass has been further processed. In general, the method may be applied in the pulp and paper industry.

The biomass may for instance be wood material, such as eucalyptus, poplar and other hardwood or species like pine, spruce and other soft wood. The biomass may also be agro waste, such as straw, especially wheat straw and sugarcane straw, corn cobs and corn stover, hulls or empty fruit bunches. The biomass may also be grass, for example giant reeds, miscanthus, *Arundo donax*, or energy grass. Furthermore, the biomass may be a residual material from the sugar or ethanol industry, like bagasse, sugar cane straw, or sugar beet pulp.

The feeding of the reactor unit with biomass is ensured by the plug screw which conveys the biomass into the reactor unit where the impregnation of the biomass takes place. The plug screw may also be defined as plug screw feeder. In particular, the plug screw may be a part of the plug screw feeder. After the impregnation of the biomass in the reactor unit, the impregnated biomass is discharged from the reactor unit and afterwards conveyed to a hydrolysis stage, for example.

The plug screw is a conveyor means which, by rotating around an axis, conveys the biomass into the reactor unit. By means of the plug screw, it is possible to generate a plug of biomass at an inlet of the reactor unit.

The reactor unit may have the shape of a longitudinal container or pipe, which is filled with the reactant to a predetermined fill level or height of the container or pipe. In particular, the reactor unit may have the shape of a longitudinal vessel, wherein the vessel is filled with the reactant to a predetermined fill level or height of the vessel. The longitudinal reactor unit may be vertically arranged with respect to the Earth's surface such that the reactor unit is filled to the predetermined fill level over its whole diameter or over its whole width. The biomass, which is fed into the reactor unit, may enter the reactor unit at a bottom part of the reactor unit such that the biomass is then conveyed to an upper part of the reactor unit where the impregnated biomass is discharged. Advantageously, such an arrangement of the reactor unit provides a complete, e.g. a homogeneous and even impregnation of the biomass as the biomass is fully penetrated by the liquid reactant. The impregnation may occur without chemicals reaction, i.e. there may be no reaction between the biomass and a chemical.

The reactor unit may have a height between about 1 meter and about 20 meters. The cross-section of the reactor unit may have the shape of a circle or a substantially elongated cross-section, e.g. an oval cross-section. The diameter of the reactor unit may be between 0.15 meters and 2.5 meters.

The feeding of the reactor unit is preferably located in the upstream or bottom part of the reactor unit, for example between 0 meters and 1 meter measured from the bottom of the vertical reactor unit. The bottom part of the reactor unit is preferably coupled to an expansion cone or inlet cone that is a part of a retaining member. The retaining member will be described in more detail in the description of the Figures.

The inlet for the reactant may be located at different positions in the expansion cone. For example, under the cone, over the cone or regularly positioned around the cone. The inlet may also be located at the bottom of the reactor unit, for example under the reactor unit, or at different other positions at the reactor, e.g. at a side wall of the reactor unit. The discharge is performed preferably at the top of the reactor, e.g. at the downstream part of the reactor. A transport screw may be used to transport the impregnated material out of the reactor unit, for example to a chute. The impregnated biomass may also fall directly into a chute or into a transport device or conveyor located downstream of the reactor unit.

According to an embodiment of the invention, the method comprises a further step in which the biomass is compressed by means of the plug screw before feeding the biomass into the reactor unit.

Thus, the plug screw is also configured for compressing the biomass in addition to feeding the biomass into the reactor unit. The compression is advantageous because the biomass, as it is delivered by a supplier for example, can be a very bulky material. This is especially the case if non-wood material is used. This bulky material can be compressed such that a plug of biomass is generated before entering the reactor unit. In the plug screw, a volumetric compression of the biomass occurs due to the geometry of the screw. However, a compression also occurs in a plug pipe which is adapted for transferring the biomass to the reactor unit. The compression in this plug pipe is due to friction and to the pressure applied by a retaining member, e.g. a blow back damper, as will be described hereinafter. The plug pipe may be the portion of the plug screw feeder located downstream of the plug screw, i.e. the plug pipe may be the end of the volumetric compression area in which the volumetric compression of the biomass is carried out.

According to an embodiment of the invention, a pre-compression of the biomass is conducted by means of a force-feed screw before feeding the biomass into the reactor unit. In this case, the biomass is pre-compressed by the force feed screw before it is compressed by the plug screw during the compression step. In other words, the biomass may first be pre-compressed by the force feed screw, then compressed by the plug screw and then fed into the reactor unit for impregnation.

In general, when using bulky material, it is beneficial to use a force-feed screw to feed the plug screw and afterwards the reactor unit in order to increase the compression and to generate a more compacted plug. In particular, a force-feed screw for pre-compressing may be advantageous if the biomass is a non-wood material. However, it is not necessary to use a force-feed screw, especially if the biomass is a high-density material, such as wood. A force-feed screw may also support the feeding of the reactor unit with the respective biomass. It should be mentioned that the force-feed screw may be integrated into the feeding step of the reactor unit in addition to the plug screw. For example, if bulky material is used, it is advantageous to use the pre-compression step with the force feed screw before the material is compressed by the plug screw in the compression step. Both pre-compression and compression may thus be combined before feeding the compressed biomass into the reactor unit. If no bulky material is used the pre-compression step can be omitted.

According to an embodiment of the invention, a volumetric compression ratio during compression with the plug screw is between 1.5 and 6, preferably between 1.7 and 3. For example the volumetric compression ratio is 1.9. The volumetric compression ratio may also be between 3.5 and 5.

These compression ratios achieve the best results with respect to a preparation of the biomass for impregnation. The density ratio obtained due to pre-compression by means of the force-feed screw may be between 1.45 and 8, preferably between 1.5 and 2.5. The pre-compression ratio may also be between 3 and 5. During the compression, a dewatering of the biomass may occur. It is possible that the pre-compression in the force feed screw is not a volumetric compression.

After the pre-compression with the force feed screw a bulk density between about 100 kg/m$^3$ to 200 kg/m$^3$, preferably between about 100 kg/m$^3$ to 140 kg/m$^3$, more preferably of about 120 kg/m$^3$ and most preferably of about 160 kg/m$^3$ can be achieved.

According to another embodiment of the invention, the biomass is conveyed by means of at least one conveyor means within the reactor unit during impregnation of the biomass.

The conveyor means may for instance be a conveyor screw which from a structural point of view may be equal or similar to the plug screw for feeding the reactor unit. Preferably, the conveyor means may comprise two conveyor screws which convey or carry the biomass within the reactor unit, e.g. along a longitudinal axis of the reactor unit. This aspect will further be described in the description of the drawings.

However, the conveyor means is adapted to transport the biomass within the reactor unit during impregnation and after impregnation. Therefore, the conveyor means transports the biomass from an inlet of the reactor unit to an outlet of the reactor unit at which the impregnated biomass is discharged from the reactor unit. It is possible that a velocity with which the biomass is conveyed through or within the reactor unit can be set. For example, if conveyor screws are used, a rotation velocity of the conveyor screws may be set. In this manner, the total residence time of the biomass within the reactor unit can be set. In particular, it is possible that, if the predetermined fill level is given, the residence time of the biomass within the reactor unit below the fill level, e.g. during impregnation, and the residence time of the biomass within the reactor unit above the fill level, e.g. after impregnation can be adjusted. However, the velocity with which the biomass is transferred through the reactor unit is selected such that an accumulation of the material at the bottom of the reactor unit can be avoided.

According to an embodiment of the invention, the reactant to be filled into the reactor unit is provided from a reservoir and/or via a recirculation circuit from a further processing step following the discharge of the impregnated biomass. The reservoir may be a tank, in particular, a chemicals tank. Furthermore, the reactant may also be discharged pressate from the plug screw before entry into the reactor unit, for example if the biomass contains acid or reactant.

According to an embodiment of the invention residual reactant from the impregnated biomass is removed in a further processing step following the discharge of the impregnated biomass out of the reactor unit. The residual reactant is supplied into a recirculation circuit. The reactant to be filled into the reactor unit is provided from the recirculation circuit and/or from a reservoir.

Using a recirculation circuit from a further processing step provides the advantage that reactant which has already been used to impregnate the biomass and which afterwards was separated from the impregnated biomass, can again be used for impregnation in the reactor unit. A further processing step may for instance be a dewatering stage, a hydrolysis stage, or another treatment process following the discharge of the impregnated biomass from the reactor unit.

As an alternative or in addition to the usage of a recirculation circuit, a reservoir from which the reactant is filled into the reactor unit can be provided. The amount of reactant which is supplied from the reservoir can be regulated depending on the amount of reactant which is supplied by the recirculation circuit. In this manner, it may be possible that a constant fill level within the reactor unit can be achieved.

According to another embodiment of the invention, a constant fill level of the reactant within the reactor unit is provided or controlled such that the biomass can be homogenously impregnated during a specified impregnation time.

The impregnation time may be defined as the time during which the biomass is conveyed within the reactor unit below the predetermined fill level. If the impregnation time amounts to 0 seconds, then all the added liquid reactant is absorbed. Typical impregnation times are between 0 and 3 minutes, preferably between 0 and 1 minute and more preferably between 5 and 20 seconds. The fill level to be set is determined depending on the required impregnation time and the velocity which the biomass is conveyed within the reactor unit.

In this manner, it is possible that a uniform and homogenous impregnation of the biomass can be achieved over a predetermined time period. The fill level may be constant over a predetermined time period and it may also be dependent on the velocity with which the biomass is conveyed through the reactor unit, e.g. during impregnation. A constant fill level of the reactant within the reactor unit is achieved by regulating the inflow of reactant from the recirculation circuit and/or the reservoir. A constant impregnation time can also be achieved by varying the fill level if the production is varied, e.g. if the amount of biomass fed into the reactor unit per unit of time is varied.

According to an embodiment of the invention, an amount of reactant filled into the reactor unit is controlled in dependence on a pH-value of the impregnated biomass discharged from the reactor unit and/or on a pH-value of the reactant filled into the reactor unit, for example from a recirculation circuit.

The amount of reactant filled into the reactor unit may also be dependent on the desired product quality after the further processing of the impregnated biomass and/or on the pH-value of the material, e.g. the biomass. It may also be dependent on an amount of a liquid or solid fraction of the material after impregnation. It may further be dependent on the type of the material or liquid in the reactor unit.

For example, the amount of reactant to be filled into the reactor unit depends on the dry matter of biomass at the inlet into the reactor unit, and on the dry matter of biomass at the outlet of the reactor unit. Dry matter is the part of the biomass which is left after evaporation and/or after drying of the material for example at about 105 degrees C. or 45 degrees C. The dry material content is defined as dry matter expressed in % of the original material. Furthermore, the amount of reactant to be filled into the reactor unit may be adapted such that a constant impregnation time in the reactor unit is achieved. Furthermore, the amount of reactant may be adapted such that a constant fill level of the reactant within the reactor unit is provided during a predetermined time period. It is possible that the reactant is added in different concentrations in order to achieve the same impregnation quality over a predetermined period of time.

According to another embodiment of the invention, a temperature and/or a pressure to be provided within the reactor unit during impregnation is controlled.

For example, the reactor unit could be operated at atmospheric pressure and the temperature in the reactor unit may be between about 40 and 99 degrees C., preferably between about 60 and 95 degrees C., more preferably between about 65 and 90 degrees C. The temperature may be lower or higher depending on the reactant type and on the raw material, e.g. the biomass.

For example, the reactor unit may be pressurized so that the pressure above the predetermined fill level is between about 1 and 5 bars. In particular, the pressure in the reactor unit may be controlled between 1 and 5 bars. The temperature above the fill level may correspond to the pressure. The temperature below the fill level may depend on the temperature above the fill level as well as on the temperature of the reactant and the temperature of the biomass fed into the reactor unit.

In this manner, the conditions for impregnation, especially temperature and pressure conditions, may be set. A typical impregnation time, i.e. the time in which the biomass is in contact with the liquid, is between 0.5 minutes and 5 minutes, more preferably between about 0 and 3 minutes, most preferably between about 5 and 20 seconds. In case all the reactant is absorbed, the impregnation time amounts to 0 seconds. The temperature can be controlled, for example up to 95° C., preferably between about 40 and 99 degrees, more preferably between about 60 and 95 degrees C. and most preferably between about 65 and 90 degrees C.

According to another embodiment of the invention, the reactor unit is fed by means of a plug screw in a first direction before conveying the biomass along a longitudinal axis of the reactor unit during impregnation. The longitudinal axis is substantially perpendicular to the first direction, wherein a ratio between an extension of the reactor unit along the longitudinal axis and a width of the reactor unit is at least 2.

The reactor unit has an elongated shape with a longitudinal axis, along which the biomass is conveyed during impregnation. The longitudinal axis of the reactor unit is arranged substantially perpendicular with respect to a first direction in which the biomass is fed into the reactor unit by means of the plug screw.

For example, the longitudinal axis of the reactor unit is arranged substantially perpendicular to the Earth's surface such that the inlet of the reactor unit is located at a bottom part of the reactor unit, whereas the outlet or discharge of the reactor unit is located at an upper part of the reactor unit. Hence, the biomass is conveyed upwards during impregnation and is interspersed with the reactant since the reactor unit is filled with reactant to a predetermined fill level. In other words, there is no possibility for the biomass to leave the reactor unit without being homogeneously impregnated. The residence time of the biomass within the liquid reactant is between 0 and 3 minutes, preferably between 0 and 1 minute and most preferably between 5 and 20 seconds. In this manner, an even and homogeneous impregnation of the biomass is possible. The feeding of the reactor unit by means of the plug screw may be conducted in the first direction, which is substantially perpendicular to the longitudinal axis of the vertical reactor unit, and the discharge of the impregnated biomass may also be conducted in a direction which is substantially perpendicular to the longitudinal axis of the vertical reactor unit.

According to another embodiment of the invention, the feeding of the biomass into the reactor unit is interrupted by means of a retaining member, that is arranged upstream of the reactor unit. For example, the retaining member is arranged at the bottom part of the reactor unit or at the inlet of the reactor unit.

For example, the retaining member is designed as a damper or sealing member which is arranged between the feeding part and the reactor unit. The retaining member may be a part of the reactor unit which is arranged at the bottom part of the reactor unit. The retaining member may be a blow back damper. For example, the retaining member is located between the reactor unit and the plug screw of the feeding part.

A damper may be used in order to increase the density of the material, e.g. the biomass, which comes from the plug screw as well as to close the feeding inlet into the reactor unit, for example if no material is to be fed into the reactor unit. The damper may also be used to break the plug and to allow the material, e.g. the biomass, to expand in the reactor unit.

According to another aspect of the invention, a device for impregnating biomass is provided. The device comprises a compression unit having an outlet and a reactor unit having an inlet. The outlet of the compression unit is connected to the inlet of the reactor unit. The compression unit comprises a plug screw. The plug screw of the compression unit is configured for feeding the biomass into the reactor unit. The reactor unit is configured for being at least partially filled with a reactant to a predetermined fill level such that a homogenous impregnation of the fed biomass takes place when the biomass is conveyed within the reactor unit by means of a conveyor means. The conveyor means may be arranged within the reactor unit.

The reactant can be fed into the reactor unit at different positions in the reactor in order to get a more homogeneous liquid phase and impregnation below the fill level. The reactant, e.g. the recirculated reactant, may be introduced into the reactor directly after the feeding of the biomass. For example, the reactant may be added at a single or at two different positions, i.e. the reactant may be added at a first injection point and the recirculated reactant may be added at a second injection point For example, a first injection point is at the cone of the retaining member, e.g. above the retaining member. Another injection point may be positioned just below the cone of the retaining member.

Such a device provides the advantage that the biomass can be completely impregnated within a short time period. The plug screw is designed for compressing the biomass such that a plug of biomass is generated which is fed into the reactor unit in which it is subsequently impregnated. After being conveyed within the reactor unit, the biomass is discharged at an outlet of the reactor unit. From this outlet, the impregnated biomass is conveyed to further processing steps, for example a stage in which a dewatering, a steaming or a hydrolysis of the impregnated biomass takes place.

It is important that the biomass is homogenously impregnated, which can be achieved by means of the inventive device. In particular, within the reactor unit, which is filled to a predetermined fill level and into which the biomass is fed at a bottom part of the reactor unit and discharged at an upper part of the reactor unit, there is no possibility for the biomass to bypass the reactant without being impregnated. The reactant may be a fluid, preferably a liquid comprising chemicals, e.g. an aqueous solution.

A conveyor means may be attached to the reactor unit inside the reactor unit. The reactor unit can be imagined as a container or vessel or a pipe in which the biomass is transferred during impregnation. For example, the conveyor means comprises conveyor screws which transfer the biomass in an upward direction within the reactor unit, such that the whole biomass is homogenously impregnated with the reactant.

According to another embodiment of the invention, the reactor unit is at least partially manufactured of a material that is resistant to corrosion.

For example, the reactor unit is at least partially manufactured of stainless steel.

For example, the reactor unit has a first part which is manufactured of a material that is resistant to corrosion, and a second part that does not comprise such a particular material. It is possible that only the lower part of the reactor unit, into which the reactant is filled to a predetermined fill level, is made of a material that is resistant to corrosion whereas in the upper part of the vertical reactor unit, which is generally not in contact with the reactant, is made of another material which is not necessarily resistant to corrosion.

The material used for manufacturing the reactor unit may be selected depending on the process parameters, such as for example pressure, temperature, catalyst and raw material to be processed. For example, stainless steel of types 304, 316, duplex steel or equivalents may be used. Some parts of the reactor unit may be manufactured of a higher steel grade. For example, the upstream or bottom part of the vertical reactor unit, i.e. the part below the predetermined fill level is manufactured of Duplex 2507 whereas the downstream or upper part of the vertical reactor unit, i.e. the part above the predetermined fill level is manufactured of Duplex 2205. The reactant may be filled into the reactor unit by means of an injection device or dosage device which may be manufactured of a stainless steel, e.g. a higher steel grade.

An inner wall of the reactor unit may be coated with a stainless metallic or synthetic coating. For example, an epoxy-based coating may be used to protect the inner wall of the reactor unit. The reactor unit may in this case be manufactured of mild steel. Advantages are a less expensive reactor, a more flexible material selection as well as a more flexible selection of process parameters to be applied.

According to an embodiment of the invention, the plug screw of the compression unit is configured for feeding the biomass into the reactor unit in a first direction, and the conveyor means of the reactor unit is configured for conveying the biomass within the reactor unit along a longitudinal axis of the reactor unit, the longitudinal axis being substantially perpendicular to the first direction or the Earth' surface.

In this manner, it is possible that the biomass, which is fed at the bottom part of the reactor unit and conveyed to the upper part of the reactor unit for discharging, can be impregnated homogenously by the reactant since there is no possibility for the biomass to bypass the reactant without being impregnated within the reactor unit.

The reactant may be a fluid, preferably a liquid comprising chemicals, e.g. an aqueous solution.

According to an embodiment of the invention, the reactant is a liquid comprising chemicals selected from the group consisting of an acid, a catalyst or mixtures thereof.

For example, the liquid is an aqueous solution, EtOH or mixtures thereof. The chemicals are selected from the group consisting of a catalyst, an acid, a mineral acid preferably $H_2SO_4$, organic acid preferably acetic acid, nitric acid, phosphoric acid, or mixtures thereof. $H_2SO_4$ is the preferred chemical. Liquid containing acetic acid, for example from the recirculated stream, is also a preferred chemical.

In the context of the present invention, the term "reactant" is to be understood as a liquid comprising chemicals, wherein the liquid may be an aqueous solution, EtOH or a similar mixture and the chemicals may comprise a catalyst, an acid like $H_2SO_4$ or acetic acid or similar mixtures. The liquid may comprise water or another solvent. Alternatively, a mixture of water and solvent is possible. The reactant may also be a filtrate obtained from another part of the process, for example from following or previous steps of the impregnation in the reactor unit. The reactant may be derived from a recirculation of filtrates, liquids or pressates which are obtained at different positions in the process. This may, for example, be a condensate or partial condensate of a steam explosion flash vapor, a byproduct from evaporation, a distillation of fermented slurry, or a filtrate from a dewatering stage.

The recirculated liquid reactant may be treated, e.g. fractionated into several fractions. For example, solid fractions may be removed from the recirculated stream or a chemical may be removed from the recirculated stream. A screen filtration may for instance be conducted.

The reactant may be a liquid, e.g. an aqueous solution, comprising chemicals, such as acid. For example, the reactant may comprise a nitric acid, a phosphoric acid or a sulfuric acid. The temperature of the liquid should be between 45 and 99° C., 60 to 90° C., 70 to 90° C., 60 to 80° C., 105 to 140° C., 110 to 135° C., or 120 to 150° C. The pressure during the impregnation may for instance be set between atmospheric pressure and 2, 4, or 5 bars. The preferred pressure during impregnation is atmospheric pressure.

It is possible that different concentrations of chemicals are present in the liquid. An acid may for instance be $H_2SO_4$, acetic acid, nitric acid, phosphoric acid, oxalic acid, $SO_2$, lactic acid, or alkali. A possible alkali is for instance NaOH, $Na_2CO_3$ or $K_2CO_3$. A solvent like EtOH as well as a mixture of the above mentioned chemicals is possible. The amount of acid used may be controlled by the pH-value of the liquid fed into the reactor unit or the pH-value of the liquid present within the reactor unit or the pH-value of the liquid contained in the material which is discharged from the reactor unit, for example in a dewatering zone within the reactor unit. A typical acid concentration of the reactant to be filled into the reactor unit is between 0.05% and 4% for wood material, and also between 0.05% and 4% for non-wood material. The concentration of the reactant is dependent on the desired product and on the requirements of the impregnated biomass in the further processing steps. If the reactant is added to the biomass at different positions, the concentrations of the reactant at each position may be different. A typical acid makeup may be between 5 and 60 kg per ton, depending on the raw material, on the flow of the total and recirculated liquid reactant in the reactor unit, on the liquid reactant flow in general and on the target for a pH-value or an acid concentration.

Further aspects and advantages of the present invention are described in the following:

The feeding of the reactor unit can be achieved by compressing the material in a plug screw or in a similar equipment which through compression establishes a plug at the outlet of the compression unit or at the inlet into the reactor unit. The formed plug may provide a seal against the liquid, e.g. the reactant being filled into the reactor unit. Therefore, the compression unit, which may also be called feeding unit, can be described as a compression and sealing device.

Depending on the dry content of the raw material, e.g. the biomass, a dewatering can be achieved in the compression unit and also by means of the retaining member. The filtrate from the dewatering may then be sent to a waste water treatment unit, to an evaporation unit or to a washing unit. In the compression unit and/or by means of the retaining member, the air contained in the biomass which is fed into the reactor unit can also be removed. When using bulky material, it is beneficial to use a force-feed screw to feed the plug screw feeder in order to increase the compression and in order to obtain the better plug to be fed into the reactor unit. It is not necessary to use a force-feed screw with high density material, such as wood. However, wood can also be fed into the reactor unit using a force-feed screw in combination with the plug screw feeder. This is the case, especially if a mill, during operation, is switching between wood and non-wood material. The force feed screw may also be omitted. Especially, if the reactor unit is not pressurized, a force-feed screw may be omitted, depending on the raw material, e.g. the biomass, and the quality of the plug that is obtained without a force-feed screw.

The retaining member, which for instance is designed as a damper, is used to increase the density of the material which is compressed by the plug screw and/or the force-feed screw, and which is then inserted into the reactor unit. The density of the material fed into the reactor unit may depend on a possible pre-treatment and on the raw material.

The dry matter content of the material fed into the reactor unit can be controlled by the feeding system, e.g. the compression unit, and is depending on the dry content of the material fed into the feeding system.

During impregnation, the material, e.g. the biomass, may expand and therefore may act as a sponge that absorbs the reactant. In case a pre-steaming is performed, an additional suction effect may occur. This leads to a rapid and good impregnation of the material. The material is lifted up within the reactor unit by means of two conveyor screws, which also results in a mixing or stirring effect when lifting the material.

The reactant, which in the form of a liquid, is filled into the reactor unit may be kept at a constant fill level within the reactor unit. For example, the fill level of the reactant within the reactor unit is 0 to 20%, 20 to 80%, 35 to 60%, or 10 to 30% of a height or length of the reactor unit, whereas the remaining volume is used for dewatering. The level could also be adjusted such that a certain impregnation time is achieved. The impregnation time may be defined as the time during which the material is below the fill level such that the whole material is in contact with the reactant. The fill level may vary with the rotational velocity of the plug screw or of another screw or of an equipment controlling the feed rate which is located upstream of the inlet into the reactor unit. The amount of reactant to be added into the reactor unit may be dependent on the amount of reactant which is absorbed by the material, e.g. the biomass and/or on the amount of reactant which remains in the reactor unit after the impregnation. The amount of fresh reactant and/or recirculated reactant to be introduced into the reactor unit may depend on the dry matter which is introduced into the reactor unit, and the dry matter which is discharged from the reactor unit. For example, a constant dry matter introduction into the reactor unit or a constant discharge of the dry matter from the reactor unit may be set. Furthermore, a constant impregnation time and a constant fill level may represent requirements for setting the amount of fresh reactant and/or recirculated reactant which is introduced into the reactor unit. The amount of reactant introduced into the reactor unit may also be dependent on the particle size, the impregnation time, as well as the temperature within the reactor unit. The reactant may also be added in relation to the production, for example of the end product. It is possible that there is no fill level of reactant within the reactor unit such that the predetermined fill level is equal to zero. This is the case if the reactant is fully absorbed by the biomass, for example.

DETAILED DESCRIPTION OF THE DRAWINGS

Figure 1:
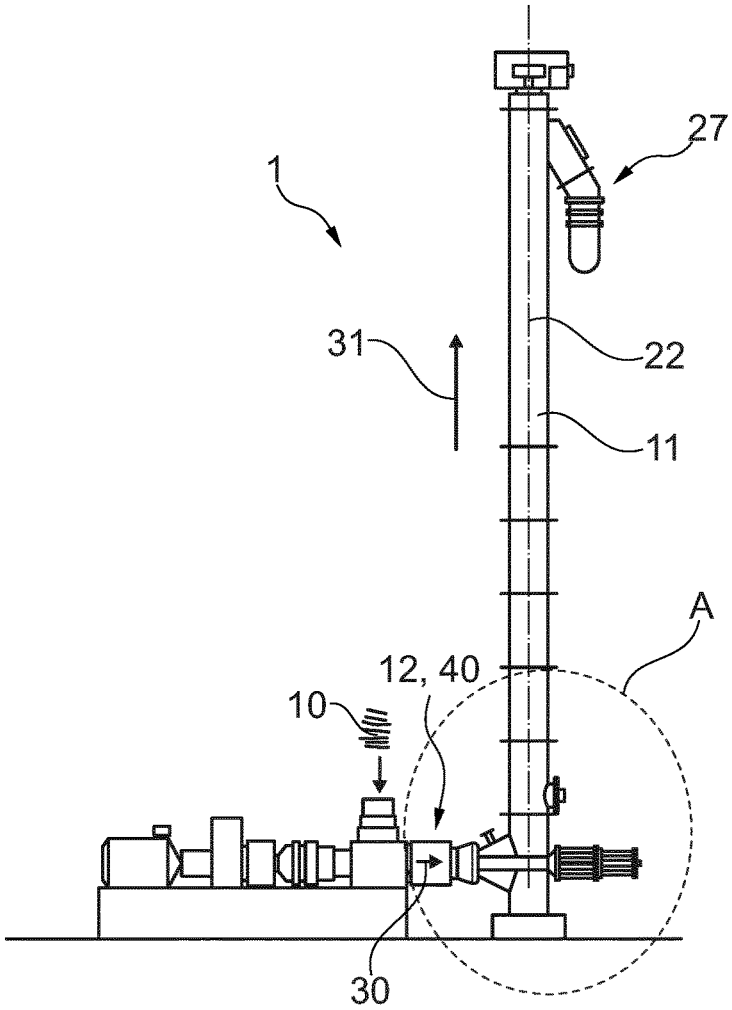
FIG. 1 shows a device for impregnating biomass, according to an embodiment of the invention.
Figure 2:
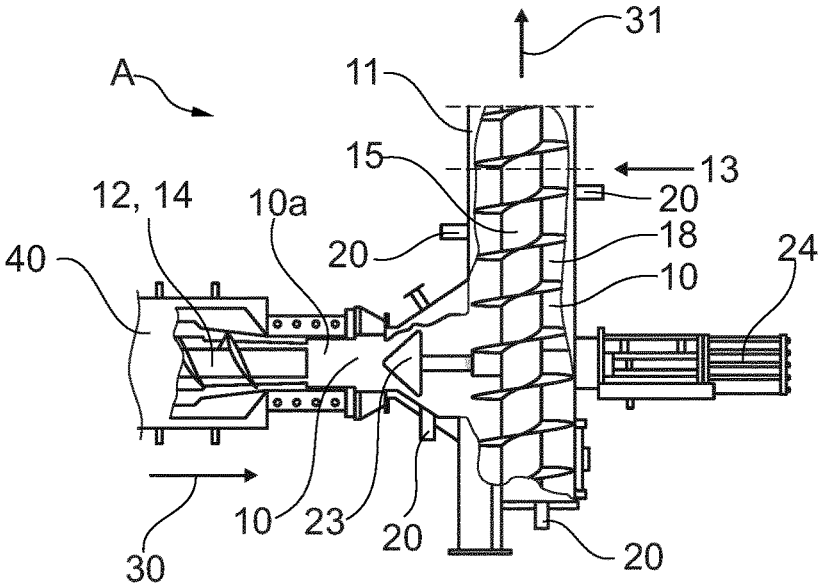
FIG. 2 shows a detailed view of a compression unit and a reactor unit of a device for impregnating biomass, according to an embodiment of the invention.

FIG. 1 shows a device 1 for impregnating biomass 10. The device 1 comprises a compression unit 40 of which FIG. 2 shows a detailed view. The compression unit 40 comprises a plug screw 12, wherein the plug screw 12 of the compression unit 40 is configured for feeding the biomass 10 into a reactor unit 11. The device 1 for impregnating biomass 10 further comprises the reactor unit 11 with a conveyor means 15, which is not visible in FIG. 1. In particular, the conveyor means 15 of the reactor unit 11 as well as the plug screw 12 of the compression unit 40 are not visible, since these elements are located inside the reactor unit 11 and the compression unit 40, respectively. However, the detailed view of FIG. 2 shows both the plug screw 12 and the conveyor means 15. In a preferred embodiment, two conveyor screws 15 are integrated into the reactor unit 11.

The reactor unit 11 may be at least partially filled with a reactant 18 to a predetermined fill level 13, wherein the reactant 18 is also not visible in FIG. 1, as it is located inside the reactor unit 11. The reactor unit 11 is at least partially manufactured of a material that is resistant to corrosion. For example, a lower part or a bottom part of the reactor unit 11 which is located near the compression unit 40 is made of a corrosion-resistant material, whereas an upper part which is near a discharge 27 of the reactor unit 11 may be manufactured of another material. The plug screw 12 of the compression unit 40 is configured for feeding the biomass 10 into the reactor unit 11 in a first direction 30, which may for instance be parallel to an Earth's surface. The conveyor means 15 of the reactor unit 11 is configured for conveying the biomass 10 within the reactor unit 11 along a longitudinal axis 22 of the reactor unit 11, which is substantially perpendicular to the first direction 30. In other words, the reactor unit 11 is arranged substantially vertical with respect to the Earth's surface which will be described in more detail in FIG. 3.

FIG. 2 shows a detailed view of at least a part of the compression unit 40, and at least a part of the reactor unit 11, wherein inner parts of both components are visible. In particular, the compression unit 40 comprises a plug screw 12 for feeding the reactor unit 11 with biomass 10 in the first direction 30. In particular, the compression of the biomass 10 by means of the plug screw 12 is conducted before feeding the biomass 10 into the reactor unit 11. Furthermore, a force-feed screw 14, which is not shown in FIG. 2, can also be integrated into the compression unit such that a pre-compressing of biomass 10 can be provided. The pre-compression of the biomass 10 by means of the force-feed screw 14 may be conducted before compressing the biomass 10 by means of the plug screw 12, and therefore also before feeding the biomass 10 into the reactor unit 11. The compression of the biomass 10 may lead to a plug 10*a* of biomass 10 at the end of the plug screw 12 in the plug pipe and before the inlet into the reactor unit 11. Between the inlet into the reactor unit 11 and the plug screw 12 of the compression unit 40, a retaining member 23 may be located in order to support the compression before feeding the biomass 10 into the reactor unit 11 as well as for sealing the reactor unit 11 from the compression unit 40. A drive 24 may be provided in order to control the position of the retaining member 23 which, for instance, is a damper. In particular, the pressure applied on the incoming plug and/or the position of the blow back damper may be controlled. The damper may thus further compress the plug in the plug pipe due to the pressure applied by the damper and due to the friction in the plug pipe.

The reactor unit 11 is filled with a reactant 18 to a predetermined fill level 13. The reactant 18 may be filled into the reactor unit 11 via inlets 20 at certain positions at the reactor unit 11. Some inlet positions are shown in FIG. 2. The inlet 20 may be located below the cone in which the retaining member is arranged. The inlet 20 may also be integrated into a side wall or a bottom end of the reactor unit 11. The inlet positions shown in FIG. 2 can be provided in an alternative manner but it is also possible that more than one of these inlet positions are provided. The reactor unit 11 may be formed as a container or a pipe with an elongated shape as shown in FIG. 1. The reactor unit 11 is at least partially filled with the reactant 18 to a predetermined fill level 13. Due to the vertical arrangement of the reactor unit 11 and the feeding of the biomass 10 into the reactor unit 11 combined with the predetermined fill level 13, an impregnation of the whole biomass 10 entering the reactor unit 11 can be achieved without the biomass 10 being bypassed by the reactant 18. Besides the improved impregnation characteristics that can be achieved by such a device 1, the impregnation time can also be reduced substantially.

Within the reactor unit 11, the biomass 10 is conveyed by means of at least one conveyor means 15, wherein the conveyor means 15 is for example a conveyor screw. Preferably, two conveyor screws are arranged within the reactor unit 11, in order to convey the biomass 10 upwards along the longitudinal direction 31 or along the longitudinal axis 22 of the reactor unit 11 during the impregnation of the biomass 10. Below the predetermined fill level 13, the biomass 10 is impregnated with the reactant 18, and above the predetermined fill level 13, a dewatering of the biomass 10 may take place. However, the biomass 10 which is impregnated in the reactor unit 11, is transferred to an upper part of the reactor unit 11 along the longitudinal direction 31, such that the impregnated biomass 10 is discharged at the discharge 27 of the reactor unit 11 for further processing. The longitudinal direction 31 of the reactor unit 11 or the longitudinal axis 22 of the reactor unit 11 is arranged substantially perpendicular to the first direction 30, and therefore the longitudinal axis 22 of the reactor unit 11 is substantially vertical to the Earth's surface which is not shown in FIGS. 1 and 2.

Figure 3:
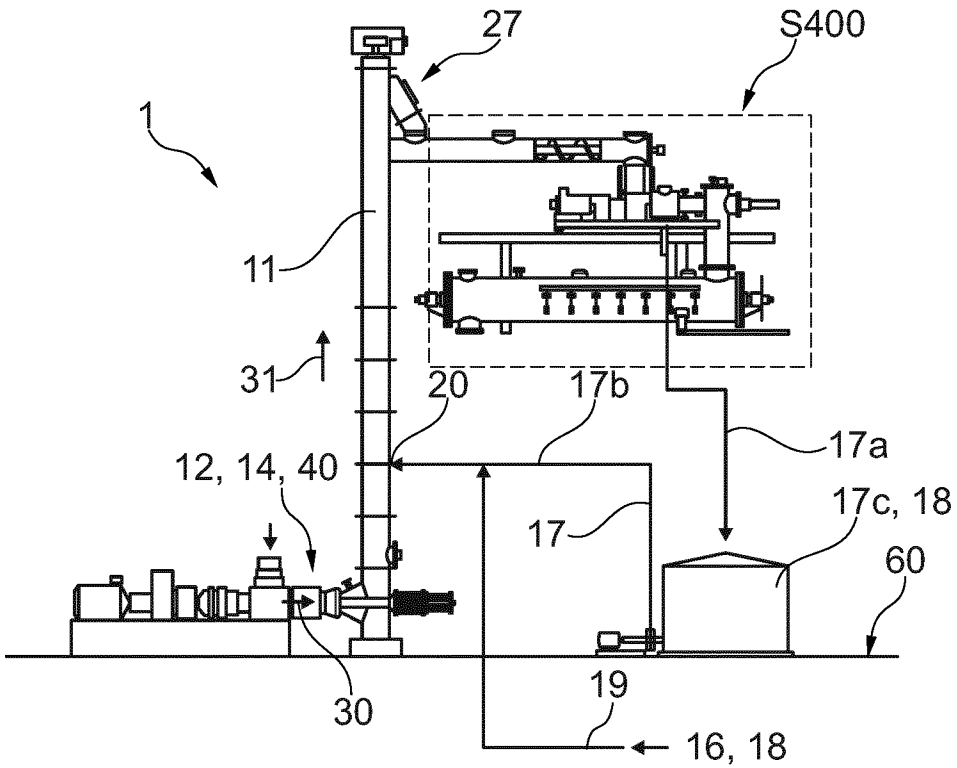
FIG. 3 shows a device for impregnating biomass as well as a further processing step after impregnating the biomass, according to an embodiment of the invention.

FIG. 3 shows the compression unit 40, the reactor unit 11, as well as a further processing step 400. The further processing step 400, which follows the discharge of the impregnated biomass at the discharge 27 of the reactor unit 11, may comprise several steps. Such steps are for example a hydrolysis step, a dewatering step, etc. FIG. 3 also shows the implementation of the device 1 for impregnating biomass 10 as well as the further processing step S400 within an environment, for example with respect to the Earth's surface 60. The reactor unit 11 is arranged substantially vertical with respect to the Earth's surface 60, whereas the feed of the reactor unit 11 by means of the plug screw 12 in the compression unit 40 is conducted in a first direction 30, which is substantially parallel to the Earth's surface 60. The reactant 18 to be filled into the reactor unit 11 is supplied from a reservoir 16, and/or via a recirculation circuit 17, which originates in the further processing step S400. In order to adjust the reactant amount, the reactant 18 may be added directly from the recirculation circuit 17 or through the reservoir 16 into the reactor unit 11. In addition to the recirculated reactant 18, fresh reactant 18 can be provided via a conduit 19. The recirculation circuit 17 may be divided into two parts. In a first part, reactant 18 or filtrate from the further processing step S400 is supplied to the tank 17*c* via a first conduit 17*a*. In a second part of the recirculation circuit 17, the reactant 18 or filtrate which is stored in the tank 17*c*, can be supplied via a second conduit 17*b* to the reactor unit 11. Within the second conduit 17*b*, another conduit 19 for fresh reactant 18 can be connected. In this manner, it is possible to provide a mixture of fresh reactant 18 and recirculated reactant 18, which has already been used for impregnation in the reactor unit 11. The recirculated reactant 18 can be filtered into separate particles and liquid reactant before recirculation. The solid phase could be for example added to the material feed in the region of the plug screw.

Figure 4:
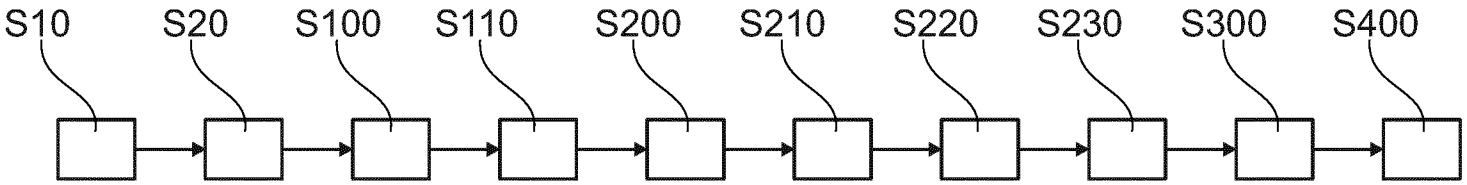
FIG. 4 shows a flow diagram of a method for impregnating biomass, according to an embodiment of the invention.

FIG. 4 shows a flow diagram for impregnating biomass 10. In a step of the method S10, a pre-compression of the biomass 10 is conducted by means of a force-feed screw 14 before feeding the biomass 10 into the reactor unit 11. In another step S20 of the method, a compression of the biomass by means of a plug screw 12 is conducted before feeding the biomass 10 into the reactor unit 11. The pre-compression by means of the force feed screw 14 as well as the compression by means of the plug screw 12 may be conducted in a combined manner. However, it is possible that only a compression by means of the plug screw 12 is conducted. In another step of the method S100, the reactor unit 11 is fed with biomass 10 by means of the plug screw 12. In another step of the method S110, an interruption of the feed of biomass 10 into the reactor unit 11 is conducted by means of a retaining member 23 that is arranged upstream of the reactor unit 11. In another step of the method S200, the reactor unit 11 is at least partially filled to a predetermined fill level 13 with a reactant 18, such that a reaction between the fed biomass 10 and the reactant 18 takes place in order to obtain an impregnated biomass. In another step S210, the biomass 10 is conveyed by means of at least one conveyor means 15 within the reactor unit 11 during impregnation of the biomass 10. In another step S220, an amount of reactant 18 filled into the reactor unit 11 is adapted in dependence on a pH-value of the biomass 10 and/or in dependence on an amount of biomass 10 fed into the reactor unit 11. In another step S230 of the method, a temperature and/or a pressure to be provided within the reactor unit 11 during impregnation is controlled. In another step of the method S300, the impregnated biomass from the reactor unit 11 is discharged for further processing, for example into a further processing step S400.

While the invention has been illustrated and described in detail in the drawings and the foregoing description, such illustration and description are to be considered illustrative and exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims. In the claims the term "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of protection.

The invention claimed is:

1. A method for impregnating biomass (10), the method comprising:

feeding a reactor unit (11) with biomass (10) by means of a plug screw (12, S100);

conveying the biomass (10) by means of at least one conveyer screw (15) within the reactor unit (11) during impregnation of the biomass (10, S210);

at least partially filling the reactor unit (11) up to a predetermined fill level (13) with a reactant (18), such that a reaction between the fed biomass (10) and the reactant (18) takes place in order to obtain an impregnated biomass (S200);

controlling the fill level (13) such that it is constant over a predetermined time by regulating inflow of the reactant (18) into the reactor unit (11);

determining the fill level (13) depending on the velocity with which the biomass (10) is conveyed through the reactor unit (11), wherein the velocity is regulated by rotational velocity of the conveyor screw (15); and discharging the impregnated biomass (10) from the reactor unit (11) for further processing (S300).

2. The method for impregnating biomass (10) of claim 1 further comprising compressing the biomass (10) by means of the plug screw (12) before feeding the biomass (10) into the reactor unit (11, S20).

3. The method for impregnating biomass (10) of claim 2 further comprising pre-compressing the biomass (10) by means of a force feed screw (14) before feeding the biomass (10) into the reactor unit (11, S10).

4. The method for impregnating biomass (10) of claim 2, wherein the volumetric compression ratio during compression with the plug screw (12) is between 1.5 and 6.

5. The method for impregnating biomass (10) of claim 4, wherein the volumetric compression ratio during compression with the plug screw (12) is between 1.7 and 3.

6. The method for impregnating biomass (10) of claim 4, wherein the volumetric compression ratio during compression with the plug screw (12) is about 1.9.

7. The method for impregnating biomass (10) according to claim 1 further comprising removing residual reactant (18) from the impregnated biomass (10) in a further processing step (S400) following the discharge (S300) of the impregnated biomass (10) out of the reactor unit (11); supplying the residual reactant (18) into a recirculation circuit (17); and providing the reactant (18) to be filled into the reactor unit (11) from the recirculation circuit (17) and/or from a reservoir (16).

8. The method for impregnating biomass (10) according to claim 1 further comprising controlling a constant fill level (13) of the reactant (18) within the reactor unit (11) such that the biomass (10) can be homogeneously impregnated during a specified impregnation time.

9. The method for impregnating biomass (10) according to claim 1 further comprising controlling an amount of reactant (18) filled into the reactor unit (11) in dependence on a pH-value of the impregnated biomass (10) discharged from the reactor unit (11) and/or on a pH-value of the reactant (18) filled into the reactor unit (11).

10. The method for impregnating biomass (10) according to claim 1 further comprising controlling a temperature and/or a pressure to be provided within the reactor unit (11) during impregnation (S230).

11. The method for impregnating biomass (10) according to claim 1 further comprising feeding the reactor unit (11) by means of a plug screw (12) in a first direction before conveying the biomass (10) along a longitudinal axis of the reactor unit (11) during impregnation, the longitudinal axis (22) being substantially perpendicular to the first direction, wherein a ratio between an extension of the reactor unit (11) along the longitudinal axis (22) and a width of the reactor unit (11) is at least 2.

12. The method for impregnating biomass (10) according to claim 1 further comprising interrupting the feed of biomass (10) into the reactor unit (11) by means of a retaining member (23) that is arranged upstream of the reactor unit (11, S110).

13. The method for impregnating biomass (10) according to claim 1, wherein the reactant is a liquid comprising chemicals selected from the group consisting of an acid, a catalyst or mixtures thereof.

14. A device (1) for impregnating biomass (10), the device comprising:

a compression unit (40) having an outlet; and a reactor unit (11) having an inlet;

wherein:

the outlet of the compression unit (40) is connected to the inlet of the reactor unit (11);

the compression unit (40) comprises a plug screw (12) which is configured for feeding the biomass (10) into the reactor unit (11);

the reactor unit (11) is configured for being at least partially filled with a reactant (18) up to a predetermined fill level (13) such that a homogeneous impregnation of the fed biomass (10) takes place when the biomass (10) is conveyed within the reactor unit (11) by means of conveyor screw (15);

the reactor unit (11) is configured for controlling the fill level (13) such that it is constant over a predetermined time by regulating inflow of a reactant (18) into the reactor unit (11); and the reactor unit (11) is configured for determining the fill level (13) depending on the velocity with which the biomass (10) is conveyed through the reactor unit (11)), wherein the velocity is regulated by rotational velocity of the conveyor screw (15).

15. The device (1) for impregnating biomass (10) of claim 14, wherein the reactor unit (11) is at least partially manufactured of a material that is resistant to corrosion.

16. The device (1) for impregnating biomass (10) of claim 14, wherein the plug screw (12) of the compression unit (40) is configured for feeding the biomass (10) into the reactor unit (11) in a first direction (30); and wherein the conveyor means (15) of the reactor unit (11) is configured for conveying the biomass (10) within the reactor unit (11) along a longitudinal axis (22) of the reactor unit (11), the longitudinal axis (22) being substantially perpendicular to the first direction (30).

* * * * *